United States Patent [19]

Smith

[11] Patent Number: 4,765,001

[45] Date of Patent: Aug. 23, 1988

[54] SPLASH GUARD FOR BATHTUB SHOWERS

[76] Inventor: William J. Smith, 7371 Far Hill Dr., Painesville, Ohio 44077

[21] Appl. No.: 87,467

[22] Filed: Aug. 20, 1987

[51] Int. Cl.[4] ..... A47K 3/14

[52] U.S. Cl. ..... 4/609

[58] Field of Search ..... 4/609, 559, 610, 661, 4/558, 608; D23/304, 305, 306, 307; 24/462; 160/349, 350, 330, DIG. 6; 49/50, 55, 52

[56] References Cited

U.S. PATENT DOCUMENTS

| | | | |
|---|---|---|---|
| D. 271,516 | 11/1983 | Dose | D23/307 |
| D. 284,024 | 5/1986 | Olson | D23/304 |
| 3,205,547 | 9/1965 | Riekse | 4/608 |
| 3,639,919 | 2/1972 | White | 4/558 |
| 3,855,642 | 12/1974 | Blitch | 4/609 |
| 3,879,806 | 4/1975 | Armstrong | 4/610 |
| 3,952,337 | 4/1976 | Hansow | 4/609 |
| 4,077,072 | 3/1978 | Dezura | 4/608 |
| 4,189,790 | 2/1980 | Masters | 4/609 |
| 4,558,475 | 12/1985 | O'Brien | 4/609 |
| 4,698,880 | 10/1987 | Hamm | 24/462 |

*Primary Examiner*—Henry J. Recla
*Assistant Examiner*—L. J. Peters
*Attorney, Agent, or Firm*—Fay, Sharpe, Beall, Fagan, Minnich & McKee

[57] ABSTRACT

A splash guard for a bathtub provided with a shower curtain includes a first extruded plastic channel strip, which is fastened to the adjacent bathroom wall on each side of the bathtub. A second channel strip is positioned on the top wall of the bathtub. First and second support rods are positioned in a respective one of the first and second channel strips. A third support rod is attached to a top end of the first support rod. A flexible panel of material is held by the first, second and third support rods. The flexible material is secured to the support rods so that the top and bottom as well as the sides of the splash guard are supported. The channel strip may also be used as a snap-in lock rod support for holding a tablecloth material on picnic tables or for some other equivalent use.

13 Claims, 4 Drawing Sheets

FIG. 5
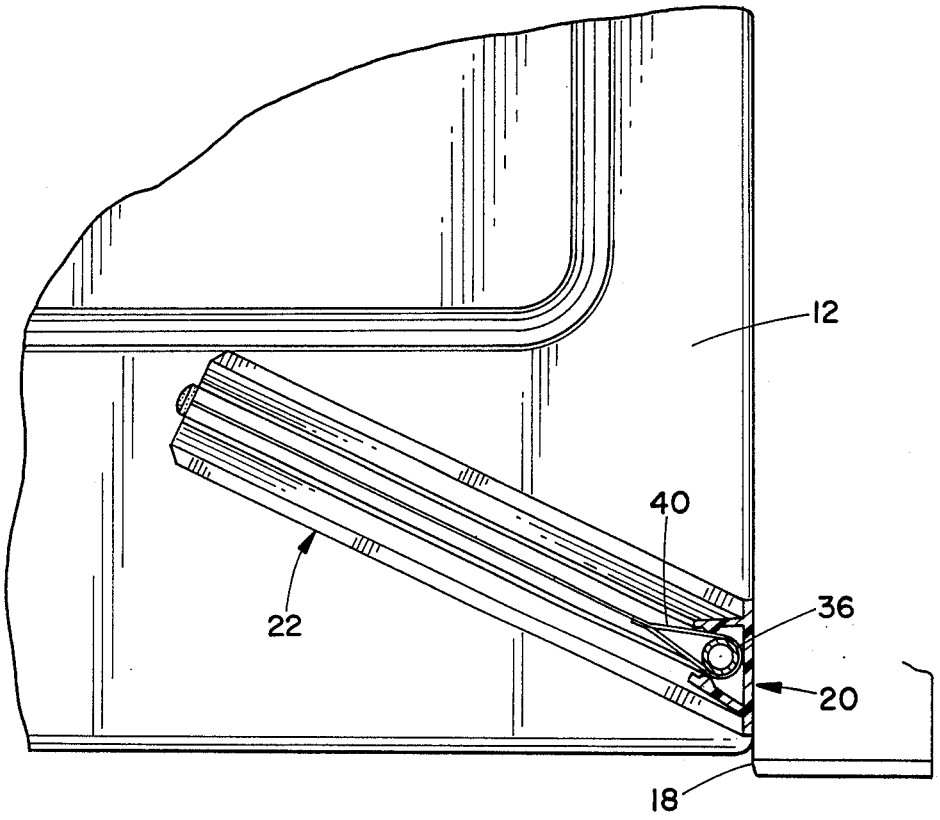
FIG. 7
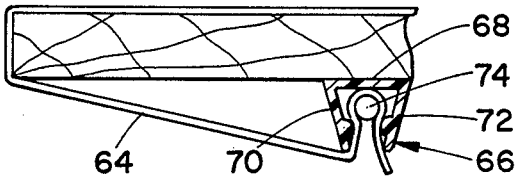
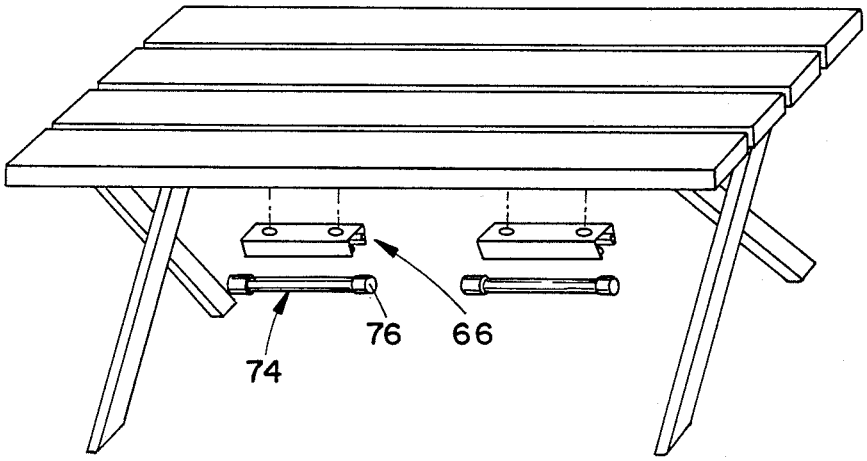
FIG. 6

SPLASH GUARD FOR BATHTUB SHOWERS

BACKGROUND OF THE INVENTION

The present invention relates generally to a device for attaching a flexible material to a support surface. More specifically, one embodiment of this invention relates to a shower splash guard for a bathtub. Another embodiment of the invention relates to an assembly for holding a tablecloth in place.

Heretofore, shower or splash guards were, in general, of the fixed panel variety. However, such fixed panels have not proven to be satisfactory in use in that they cannot flex when disturbed and are therefore easily broken or detached from the bathroom wall. It would be advantageous to provide a flexible splash guard panel for a bathtub shower.

Also, flexible material in general has been difficult to secure to a rigid surface in a selectively detachable manner. For example, at picnics a tablecloth if not weighted down on a picnic table will tend to be blown away by gusts of wind. It would be advantageous if the tablecloth could be selectively secured to the picnic table so that it will stay in place when desired but be readily removable for cleaning.

Accordingly, it has been considered desirable to develop a new and improved device for attaching a flexible material to a support surface which would overcome the foregoing difficulties and meet the above-stated needs and others while providing better and more advantageous overall results.

SUMMARY OF THE INVENTION

The subject invention is directed to a splash guard for a bathtub shower comprising a substantially heavy extruded plastic channel strip and a snap-in lock rod resiliently held in the channel strip for the support of a flexible panel of vinyl material, such as a shower curtain or the like. The flexible panel material is secured to the rods which are then snapped in the channel strips on the bathroom wall and on the top of the tub. A top edge of the panel is secured to a resiliently supported rod.

The splash guard, of course, prevents water from splashing against a person's body and then to either side of the shower curtain. The shower curtain because it is held loosely in the tub enclosure over a period of minutes causes a substantial volume of water to splash out of the tub, which can be a real nuisance in one's home or at a hotel. Constant maintenance is normally required against water damage. A simple splash guard as described herein may be inserted in the shower tub. The guard comprises a pair of six-inch—to nine-inch-wide panels or strips, the purpose of which is to prevent water from splashing out and around the ends of a shower curtain.

In accordance with the present invention, a splash guard adapted for use with a bathtub for preventing water from an adjacent wall mounted shower head from splashing between the bathroom wall and the adjacent side edge of a suspended shower curtain is provided.

More particularly in accordance with the invention, the splash guard includes a first channel fastened to a first substantially vertical bathroom wall adjacent one end of the bathtub. A first rod is held in the first channel. A second channel is positioned on a substantially horizontal top wall of the bathtub and is secured to the first channel. A second tube is held in the second channel. A third tube is resiliently mounted in a substantially horizontal direction to a top end of the first tube. A flexible panel of sheet material is attached to the first, second and third tubes.

In accordance with another aspect of the invention, preferably the first channel and the first tube are substantially elongated while the second channel and the second and third tubes are relatively short in relation to the first channel and the first tube.

In accordance with still another aspect of the invention, the first and second channels are made from a plastic material, and the panel is also made from a plastic material.

In accordance with yet another aspect of the invention, the flexible panel of sheet material is looped around the first, second and third tubes.

According to another aspect of the invention, the first and second channels each comprise a base wall and first and second side walls. Preferably, the first and second side walls of each of the channels are inclined inwardly towards each other so that the width of the base wall is larger than the distance between the first and second side walls at their free ends.

According to still another aspect of the invention, each of the first and second side walls is provided with a rib, with the ribs and the channel base wall of each of the first and second channels contacting the sheet material looped around the respective first and second tubes.

According to a further aspect of the invention, a holder is provided for holding a flexible material.

More particularly in accordance with this aspect of the invention, a rod is provided and an associated flexible sheet material is looped around the rod. A channel strip is provided in which the rod is adapted to be placed. The channel strip includes a base wall and a pair of inwardly inclined side walls which have an opening therebetween at their free ends that is of smaller diameter than the rod which is adapted to be placed therein. The associated flexible sheet material is securely fastened in this way to the channel strip.

According to a still further aspect of the invention, there is a snug fit of the rod in the channel strip with the rod resting on the channel strip base wall and contacting the channel strip side walls to hold the associated flexible sheet material firmly therebetween.

In accordance with a yet further aspect of the invention, the side walls of the channel strip each include a protrusion which is positioned near the free edge of the side wall and faces inwardly.

One advantage of the present invention is the provision of a device for attaching a flexible material to a support surface.

Another advantage of the present invention is the provision of a means for selectively securing a flexible material to a rigid surface so that the material can be readily detached when required.

Still another advantage of the present invention is that it provides for a flexible splash guard panel that is not easily disturbed or broken and is capable of containing splashing water in a bathtub.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein:

FIG. 5 is a cross-sectional view taken on line 5—5 of FIG. 3 showing the position of the channel strip as mounted on a bathtub ledge;

FIG. 6 is a perspective view of a picnic table and the manner in which a channel according to a second preferred embodiment of the present invention may be installed to hold down a tablecloth;

FIG. 7 is an enlarged end elevational view of the table of FIG. 6 with the channel strip mounted on the underside of a table; and, FIG. 8 is a partial cutaway view of an alternate embodiment of the upper corner of the splash guard.

DETAILED DESCRIPTION OF THE PREFERRED EMBODIMENTS

Figure 1:
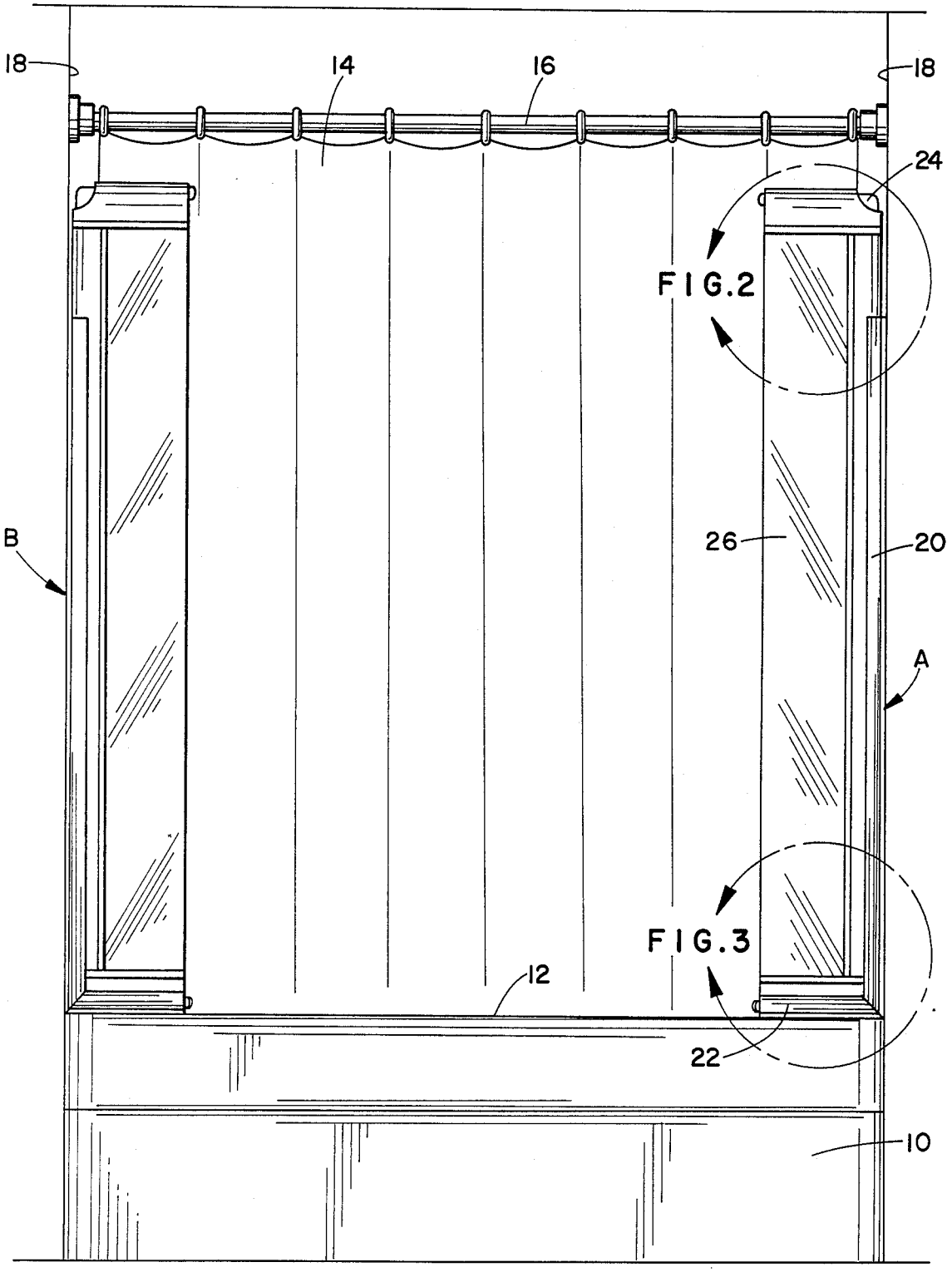
FIG. 1 is a front elevational view of the shower tub splash guard in accordance with a first preferred embodiment of the invention described herein.

Referring now to the drawings wherein the showings are for purposes of illustrating preferred embodiments of the invention only and not for limiting same, FIG. 1 shows a pair of splash guards A and B for a bathtub 10 having a ledge or top wall 12 and a shower curtain 14 which is supported thereabove on a rod 16 against a pair of enclosing end wall surfaces 18. Since both end walls have an identical splash guard, only the right splash guard A will be discussed in detail, it being appreciated that the other splash guard B has the identical elements. To form the splash guard A, a first channel strip 20 is mounted to the bathtub wall surface 18 by a suitable conventional means such as an adhesive or a fastening anchor. A second short channel strip 22 is similarly secured to the bathtub ledge 12. Also provided are a top supporting tube or rod 24 and a flexible panel material 26.

Figure 2:
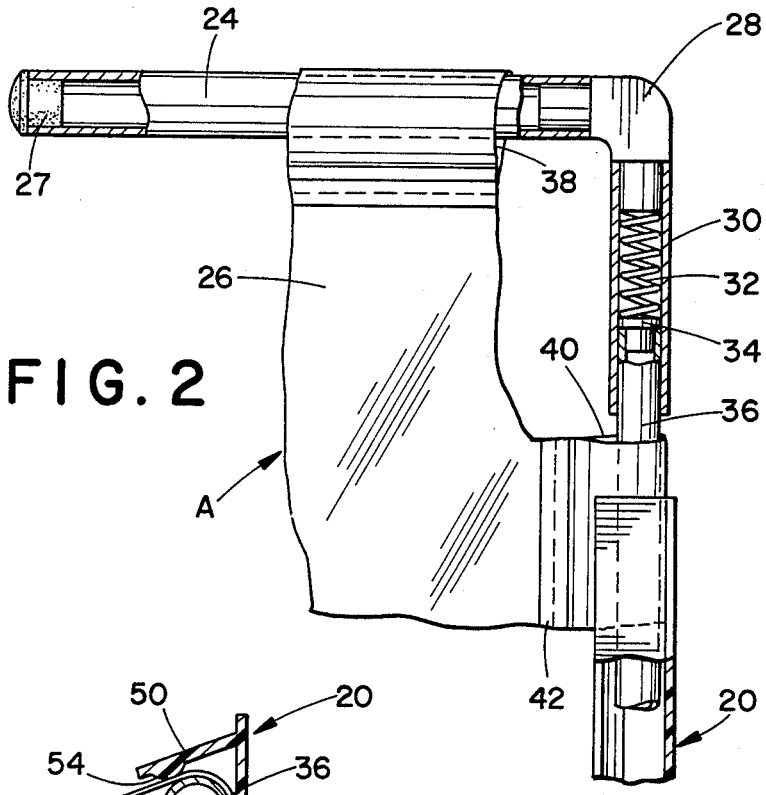
FIG. 2 is an enlarged partial cutaway view of an upper corner of the splash guard of FIG. 1.

In FIG. 2, note the splash guard A and its top supporting rod 24. The supporting rod has an end cap 27 at the free end thereof. The rod 24 is secured by means of an elbow 28 to another rod 30 having enclosed therein a coil spring 32 and a plug 34 which is secured on a top end of a tube or lock rod 36. The coil spring 32 provides for a limited amount of vertical motion of the top supporting rod 24, and hence flexing of the panel 26, in the event that the splash guard is touched by the human body. Such motion of the coil spring is provided to prevent tearing or ripping of the panel material. Preferably, the panel 26 is made from a suitable fabric which may be a plastic such as vinyl, or the like. The top supporting rod 24 is preferably positioned above the first channel strip 20, and the flexible vinyl material is secured in loop fashion as shown at 38 around the top supporting rod. The panel material is similarly looped on its right side as will be noted at 40 so that it can be secured to itself as shown at 42.

Figure 3:
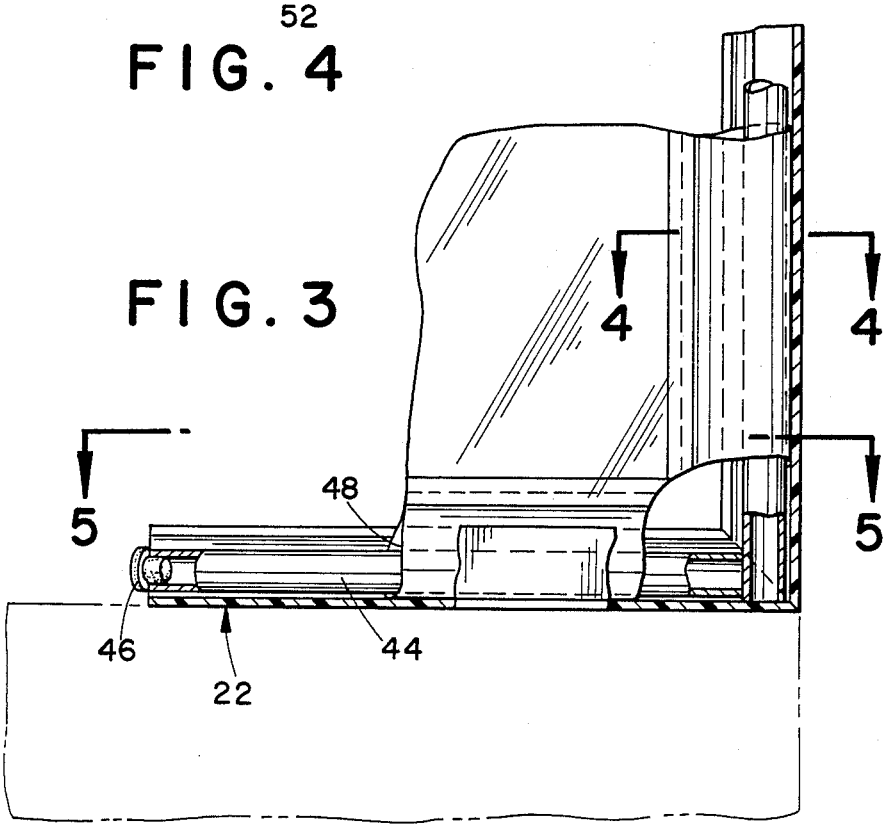
FIG. 3 is an enlarged partial cutaway view of a lower corner of the splash guard of FIG. 1 shown supported against the wall and the shower tub.

The flexible panel of vinyl material is similarly fixed, as shown in FIG. 3, to the bottom channel strip 22. The two channels 20, 22 are preferably made of a suitable conventional material such as an extruded plastic or the like. The panel 26 is looped around a tube or lock rod 44 which has on a free end thereof an end cap 46. A loop 48 of panel material is illustrated around the lock rod 44 so that the panel can be frictionally secured in channel strip 22. The rods or tubes 24, 36, 44 can be made of any suitable conventional material such as aluminum or plastic. Preferably the end caps 27, 46 are made of a suitable conventional material such as a soft vinyl which aids in gripping the panel material.

Figure 4:
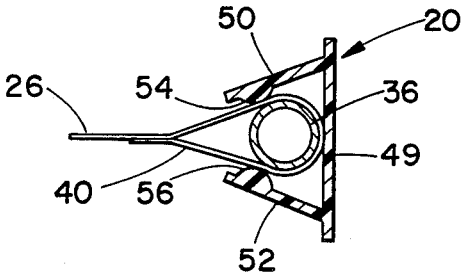
FIG. 4 is a cross-sectional view taken on line 4—4 of FIG. 3 showing a channel strip with a snap-in locking rod in place supporting a panel of flexible material.

FIG. 4 shows the channel strip 20 in cross-sectional detail. The strip includes a bottom wall 49 and a pair of outwardly extending side walls 50 and 52. Near the free end of each side wall 50, 52 is a semi-circular lug portion or protrusion 54, 56. The protrusion can, if desired, extend longitudinally for substantially the entire length of the channel 20. Located within the channel strip is the tube 36. The vinyl material is thus looped around the tube as shown at 40. Note that the tube rests against the base wall 49 and is in flexible contact with legs 50 and 52 by contacting the protrusions 54, 56.

If it is desired to change the panel 26 for some reason, the tubes or lock rods 36, 44 can preferably be snapped out of their respective channels 20, 42 because the channels have somewhat flexible side walls since they are preferably made from a material such as plastic which allows such flexing.

As is evident from FIG. 5, the second channel strip 22 can extend at an acute angle to the front wall of the bathtub 12, if desired. This will tend to guide the shower water trapped by the splash guard back into the tub.

With reference now to a second preferred embodiment of the present invention, the channel strip and tube holder assembly disclosed herein can be used to hold a flexible covering material selectively in place on a rigid surface. In this regard, and with reference now to FIG. 6, note a picnic table 62 which can be covered with a sheet covering 64, as shown in FIG. 7. Such covering may be of a suitable conventional vinyl, paper or cloth material as desired. A plurality of channel strips 66 each having a base wall 68 and side walls 70, 72, and each having a cooperating lock rod or tube 74, can be mounted on the underside of the picnic table, in any suitable conventional manner such as by fasteners or an adhesive, as particularly shown in connection with FIG. 7. The rods or tubes 74 are preferably hollow and provided with end caps 76, made of a somewhat flexible and adhering material such as vinyl, as in the embodiments of FIGS. 2 and 4. The end caps, since they are preferably made of a plastic material such as vinyl, aid in gripping the covering 64 which is looped around the rods.

The assemblies are preferably secured six inches or more from the edge of the table. By this means the covering 64 is locked into the channel strip 66 to prevent wind from blowing off the table covering. When it is desired to remove the covering 64, the legs 70, 72 of the channel are pushed apart so that the lock rod 74 can be taken out. Then the lock rod can be detached from the covering.

Figure 8:
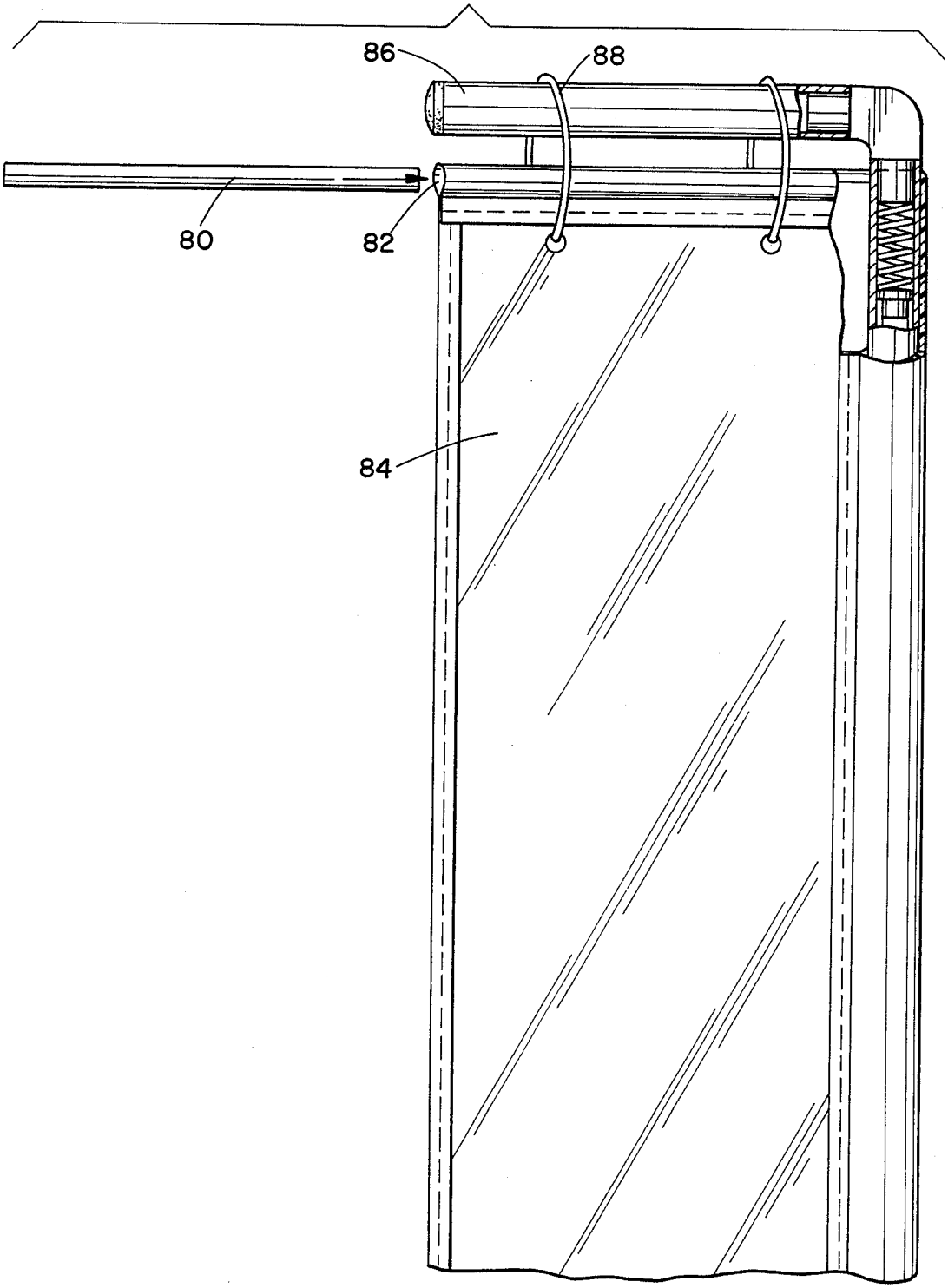

An alternate way of configuring the upper corner illustrated in FIG. 2 is shown in FIG. 8 where a support rod 80 is mounted in a loop 82 of a panel material 84. The panel 84 is secured to a top supporting rod 86 by means of conventional curtain hooks or "S" hooks 88. In all other respects, the details of this embodiment are the same as shown in the other views herein.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

I claim:

1. A splash guard for a bathtub shower including a ledge, vertical enclosing walls, a shower curtain and a support rod therefor, comprising:

a first extruded plastic channel strip fastened to an enclosing vertical wall of the bathtub shower;

a second shorter plastic channel strip positioned on a front wall ledge of the shower tub;

two rod members received in the opening of each of said channel strips;

a horizontally mounted support rod resiliently attached to an upper end of one of said rod members; and, a flexible strip of vinyl material forming the splash guard and having openings on three sides thereof for receiving the respective two rod members and horizontally mounted support rod wherein said rods and strip of vinyl material are mounted in the channel strips and said strip is taut held by the support rod.

2. The splash guard of claim 1 wherein the channel strips include a base member and inwardly inclined side portions permitting the rod to be larger in diameter than the opening between the side portions.

3. The splash guard of claim 2 wherein the inclined sides each include an inwardly facing protrusion near the outer end thereof.

4. A splash guard adapted for use with a bathtub for preventing water from an adjacent wall mounted shower head from splashing between the bathroom wall and the adjacent side edge of a suspended shower curtain, comprising:

a first channel fastened to a first substantially vertical bathroom wall adjacent one end of the bathtub;

a first tube held in said first channel;

a second channel positioned on a substantially horizontal top wall of the bathtub and secured to said first channel;

a second tube held in said second channel;

a third tube resiliently mounted in a substantially horizontal direction to a top end of said first tube; and, a flexible panel of sheet material which is attached to said first, second and third tubes.

5. The splash guard of claim 4 wherein said first channel and first tube are substantially elongated.

6. The splash guard of claim 5 wherein said second channel and said second and third tubes are relatively short in relation to said first channel and said first tube.

7. The splash guard of claim 4 wherein said first and second channels are made from a plastic material.

8. The splash guard of claim 4 wherein said sheet material is made from a plastic material.

9. The splash guard of claim 4 wherein said flexible sheet material is looped around said first, second and third tubes.

10. The splash guard of claim 9 wherein said first and second channels each comprise:

a base wall, and first and second side walls.

11. The splash guard of claim 10 wherein said first and second side walls of each of said channels are inclined toward each other so that the width of said base wall is larger than the distance between said first and second side walls at their free ends.

12. The splash guard of claim 11 wherein each of said first and second side walls is provided with a rib, said ribs and said channel base wall of said first and second channels contacting said sheet material looped around said respective first and second tubes.

13. The splash guard of claim 4 wherein said panel of sheet material is looped around a respective one of said first, second and third tubes and is secured to itself.

* * * * *